US005337669A

United States Patent [19]

Kanai

[11] Patent Number: 5,337,669

[45] Date of Patent: Aug. 16, 1994

[54] CARD PRINTING METHOD, ORIGINAL POSITIONING HOLDER, AND CARD PRINTING PAPER

[75] Inventor: Hirokazu Kanai, Tokyo, Japan

[73] Assignee: Riso Kagaku Corporation, Tokyo, Japan

[21] Appl. No.: 59,671

[22] Filed: May 12, 1993

[30] Foreign Application Priority Data

May 18, 1992 [JP] Japan ..... 4-124827[U]
Aug. 25, 1992 [JP] Japan ..... 4-059787

[51] Int. Cl.[5] ..... B41F 9/00
[52] U.S. Cl. ..... 101/485; 101/486
[58] Field of Search ..... 101/129, 485, 486, 401.1

[56] References Cited

U.S. PATENT DOCUMENTS

| | | | |
|---|---|---|---|
| 3,605,622 | 9/1971 | Zarip | 101/485 |
| 3,994,225 | 11/1976 | Sitzberger | 101/485 |
| 4,380,956 | 4/1983 | Elworthy | 101/401.1 |
| 4,516,495 | 5/1985 | Ericsson | 101/129 |
| 4,945,829 | 8/1990 | Ericsson | 101/129 |
| 4,953,459 | 9/1990 | Ericsson | 101/129 |
| 5,091,654 | 2/1992 | Coy et al. | 250/561 |
| 5,168,805 | 12/1992 | Kasanami et al. | 101/129 |
| 5,226,366 | 7/1993 | Schlife et al. | 101/485 |
| 5,272,980 | 12/1993 | Takeuchi et al. | 101/485 |

FOREIGN PATENT DOCUMENTS 2239217 6/1991 United Kingdom .

*Primary Examiner*—Eugene H. Eickholt
*Attorney, Agent, or Firm*—Dickstein, Shapiro & Morin

[57] ABSTRACT

In card printing, to allow registration and positioning of card-like originals C when making a master plate by duplication to be accomplished both easily and accurately, the card-like originals are positioned and set up on an original positioning holder for card printing 30 having original set up position designating marks 34 and registration marks according to the original set up position designating marks 34, and a printing master plate is made from the card-like originals along with the original positioning holder for card printing 30 by duplication. By using this printing master plate, the registration marks of the master plate are printed on a test print sheet carrying reference registration marks and fed by an automatic paper feeder, a misregistration is detected from relative positions of the two sets of registration marks, a base sheet carrying card-like printing sheets in a peelable manner is automatically fed, and prints are made in the prescribed locations of the card-like printing sheets with the misregistration resolved by adjusting an automatic paper feeding position.

4 Claims, 4 Drawing Sheets

CARD PRINTING METHOD, ORIGINAL POSITIONING HOLDER, AND CARD PRINTING PAPER

TECHNICAL FIELD

The present invention relates to a card printing method, an original positioning holder for card printing, and card printing paper. In particular, the present invention relates to a card printing method and an original positioning holder for card printing, and card printing paper which are suitable for the purpose of printing materials of small sizes such as cards, business cards, and post cards by using a printer equipped with means for automatically feeding cut sheet paper.

BACKGROUND OF THE INVENTION

Conventionally, various modes of cut sheet paper printers have been known in which each sheet of cut sheet paper is automatically supplied to a printing unit one sheet at a time, and a print are made on each sheet of paper.

In such a cut sheet paper printer, the adjustment of the positions of the printed images with respect to the cut sheet paper is carried out by adjusting the paper feeding timing with respect to the printing unit for vertical adjustment, and by adjusting the lateral position of the cut sheet paper on the paper feed table for lateral adjustment. Such adjustment mechanisms are disclosed, for instance in Japanese patent laid open publication (kokai) No. 2-220880 and Japanese patent laid open publication (kokai) No. 63-218435, and the contents of these prior published patent applications are herein incorporated by reference.

In such a cut sheet paper printer, there is a lower limit to the size of the cut sheet paper that can be printed, and printing on such small sized card-like printing sheets as business cards, labels, and tags have been practically impossible because they cannot be automatically fed by themselves.

Therefore, when such small sized card-like printing sheets are desired to be printed, they are typically removably attached to a base sheet having a size corresponding to the size of the cut sheet paper that can be safely printed, and the base sheet along with the card-like printing sheets is automatically fed into the printing unit.

In this case, a printing master plate is required to be prepared so as to correspond to the layout of the card-like printing sheets on the base sheet, and the adjustment of the printing positions with respect to the card-like printing sheets on the base sheet can be carried out vertically by adjusting the paper feeding timing and laterally by adjusting the position of the base sheets on the paper feed table.

Adjustment of the positions or the registration of the printed images on the card-like printing sheets arranged on the base sheet is carried out by means of test printing in the same way as in the process of printing cut sheet paper, and therefore requires human intervention. This process of registration is difficult to accomplish, and typically involves trial and error steps involving a number of test prints.

In particular, when printing business cards, inherently, an extremely accurate registration is required, and the necessary expertise in achieving the necessary accuracy of registration is beyond the reach of inexperienced users.

Further, when preparing a printing master plate such as a stencil master plate by reading an original image with an image scanner and duplicating the image on the master plate, the positioning of the original image during such a reading process must be carried out according to the layout of the card-like printing sheets on the base sheet. In particular, when a plurality of card-like printing sheets are mounted on a single base sheet, and a print is to be made on each of the card-like printing sheets, the positioning of the original image must coincide with the layout of the card-like printing sheets, and this requires an extremely high level of dexterity which is practically beyond the reach of normal users.

BRIEF SUMMARY OF THE INVENTION

In view such problems of the prior art, a primary object of the present invention is to provide a card printing method which allows small-sized objects such as cards, labels, business cards, tags and labels to be easily printed with a satisfactory level of registration.

A second object of the present invention is to provide a card printing method which allows a plurality of small-sized objects to be printed at the same time without requiring any undue efforts for achieving a desired registration.

A third object of the present invention is to provide a card printing method which can be conveniently implemented in printers which include the function of preparing printing master plate by duplication.

A fourth object of the present invention is to provide a card printing method for printers equipped with the function of preparing printing master plate by duplication which allows a plurality of small-sized objects to be printed at the same time without requiring any undue efforts for preparing the necessary printing master plate.

A fifth object of the present invention is to provide a card printing method which allows a plurality of small-sized objects to be printed at the same time by using a printer equipped with an automatic paper feeder for cut sheet printing paper.

A sixth object of the present invention is to provide an original positioning holder for card printing, and card printing paper which are suitable for use when implementing such a card printing method.

These and other objects of the present invention can be accomplished by providing a card printing method, comprising the steps of: positioning and setting up a card-like original on an original positioning holder carrying an original set up position designating mark for designating a region for setting up the card-like original and a reference registration mark which is located outside the original set up region designated by the original set up position designating mark at a prescribed positional relationship thereto, according to the original set up position designating mark; making a printing master plate from the card-like original along with the original positioning holder by duplication, the printing master plate including a master plate image part corresponding to the card-like original and a master plate mark part corresponding to the registration mark; printing at least the registration mark on a test print sheet carrying a reference registration mark printed thereon and fed to a printing unit, by using the printing master plate; detecting a misregistration from relative positions of the registration mark printed on the test print sheet with the printing master plate and the reference registration mark; feeding a base sheet carrying a card-like printing sheet in a removable manner on a position corresponding Go the original set up region designated by the original set up position designating mark to the printing unit with the misregistration resolved by adjusting an automatic paper feeding position; and printing an image of the card-like original with the master plate image part on a prescribed location of the card-like printing sheet by using the master plate image part of the printing master plate.

According to such a method, a card-like original is positioned and set up on an original positioning holder for card printing according to an original set up position designating mark carried thereby, and is used for making a printing master plate along with the original positioning holder for card printing by duplication so that a master plate image part corresponding to the image of the card-like original is produced at a position corresponding to the position of the card-like original on a base sheet along with a master plate registration mark part.

Then, at least a registration mark is printed on a test print sheet by using the master plate registration mark part, and a misregistration is detected by detecting relative positions of a thus printed registration mark and a reference registration mark printed on the test print sheet from the beginning.

Then, according to the thus detected misregistration, the misregistration is eliminated by adjusting an automatic paper feed position. A base sheet removably carrying a card-like printing sheet is automatically fed into a printing unit, and an image of the master plate image part is printed on a prescribed location of the card-like printing sheet.

Preferably, the original set up position designating mark may designate original set up regions for a plurality of card-like originals. If the original set up regions are arranged on the original positioning holder symmetrically both longitudinally and laterally, the produced printing master plate does not have any directivity, and the corresponding printing paper may be fed without regard to its feeding direction, either its head first or its tail first.

The present invention further provides an original positioning holder for card printing, comprising: a base sheet having a size suitable for feeding into a master plate making unit; an original set up position designating mark provided on a surface of the base sheet for designating an original set up region for a card-like original; and, optionally, a registration mark provided outside the original set up region designated by the original set up position designating mark at a position having a prescribed positional relationship to the original set up position designating mark.

Preferably, the original positioning holder further comprises a substantially transparent cover sheet which can selectively cover an original mounted on the original set up region so that the originals may be protected during the feeding and plate making process from dislodgement and other movement. Further, the transparent cover sheet may comprise a mask part which covers at least a marginal edge of the original mounted on the original set up region and is nonsensible to the master plate making unit so that no undesirable shadows may be produced when making the printing master plate due to the thickness of the originals.

The present invention further provides card printing paper, comprising a base sheet having a size which allows the base sheet to be fed into a printing unit of a printing device, and a card-like printing sheet removably mounted on the base sheet by way of an adhesive layer.

Further, according to a preferred embodiment of the card printing paper of the present invention, no adhesive layer is provided on the card-like printing sheet, and the card-like printing sheet is attached to the base sheet by virtue of an adhesive layer provided on the base sheet. Therefore, once the card-like printing sheet is removed from the base sheet, it will be a simple card which is acceptable as a business card.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
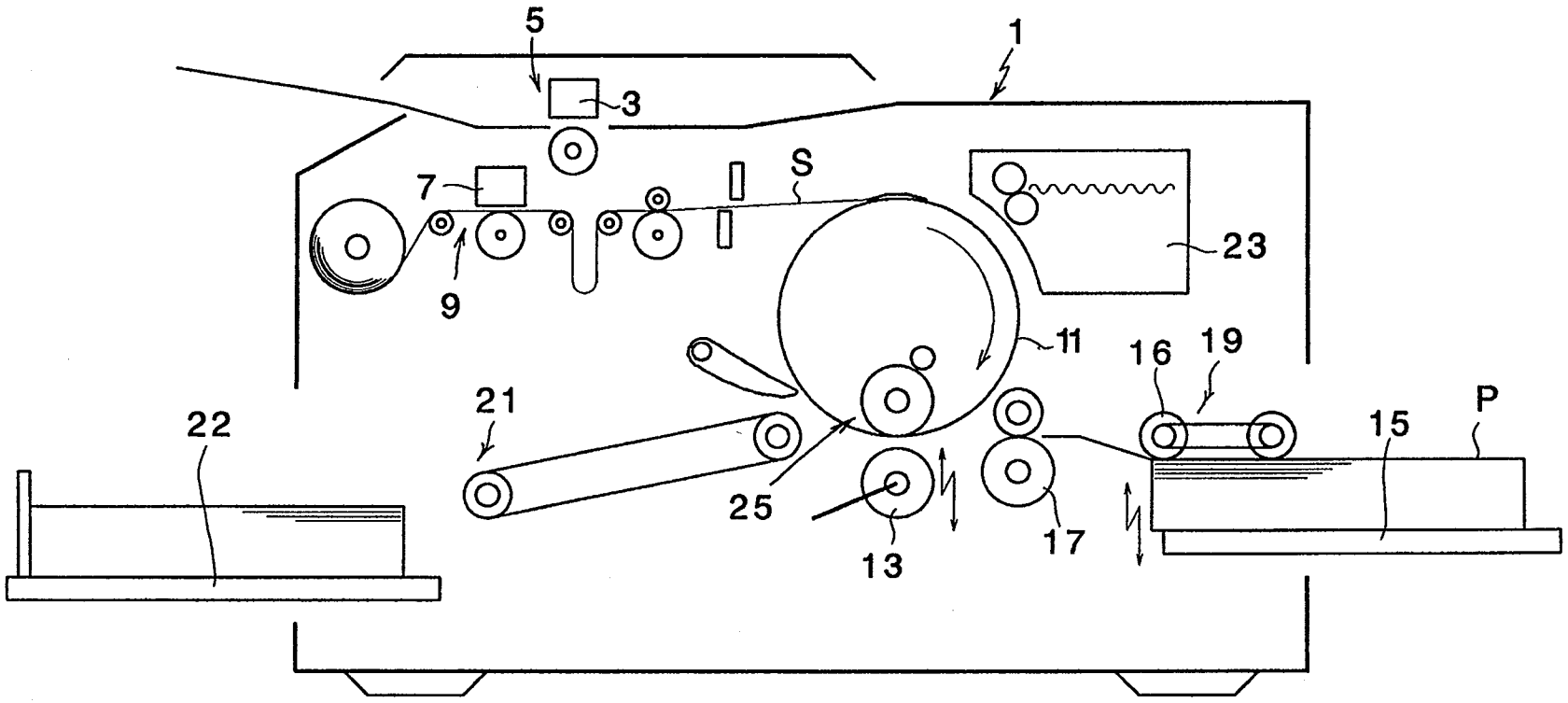
FIG. 1 is a schematic view showing an example of printing device equipped with the function of preparing a printing master plate by duplication which may be used for implementing the card printing method according to the present invention.

FIG. 1 generally illustrates a stencil printing device as an example of printing device equipped with the function of preparing a printing master plate by duplication which may be used for implementing the card printing method according to the present invention and on which the original positioning holder for card printing and the card printing paper according to the present can be used.

The stencil printing device which is generally denoted with numeral 1 comprises an original image reading unit 5, a plate making unit 9 including a thermal head 7 for thermally perforating a duplicated image on a thermally sensitive stencil master plate sheet S according to the original image data obtained by the original image reading unit 5, a cylindrical printing drum 11 around which the stencil master plate sheet S prepared by the plate making unit 9 by duplication is to be mounted, a press roller 13, an automatic paper feed unit 19 for separating each sheet of printing paper P on a paper feed table 15 with a paper separating roller 16 and feeding it to a nip formed between the printing drum 11 and the press roller 13 with a paper feed timing roller 17 at a prescribed timing, a paper ejection unit 21 for ejecting the printed paper sheets and stacking them, a master plate ejection unit 23 for removing the used stencil master plate sheet S from the printing drum 11, and disposing it, and a squeegee device 25 accommodated inside the printing drum 11.

In this printing device, the printing drum 11 is rotatively driven by rotative drive means not shown in the drawing in clockwise direction around its axial center line as seen in the drawing, and the printing paper P is supplied to a nip defined between the printing drum 11 and the press roller 13 with the printing paper P fed from right to left as seen in the drawing in synchronism with the rotation of the printing drum 11 and at an appropriate timing effected by the movement of the paper feed timing roller 17 so that the printing paper P is pressed against the stencil master plate sheet S mounted around the outer circumferential surface of the printing drum 11 by the press roller 13, and a desired stencil print is made on the printing paper P.

The paper feed timing of the paper feed timing roller 17 is variably adjusted with respect to the rotational phase of the printing drum 11 for vertical adjustment by means of a well known structure. For details of such a paper feed timing variable adjustment mechanism, reference should be made to Japanese patent laid open publication (kokai) No. 2-220880 if necessary.

The positioning of the printing paper P on the paper feed table 15 can be laterally (perpendicularly to the plane of the sheet on which the drawing is drawn) adjusted. For details of such a paper position variable adjustment mechanism, reference should be made to Japanese patent laid open publication (kokai) No. 63-218435 if necessary.

Now the mode of carrying out the card printing method and the original positioning holder for card printing according to the present invention are described in the following with reference to FIGS. 2(*a*) through (*c*).

Figure 2:
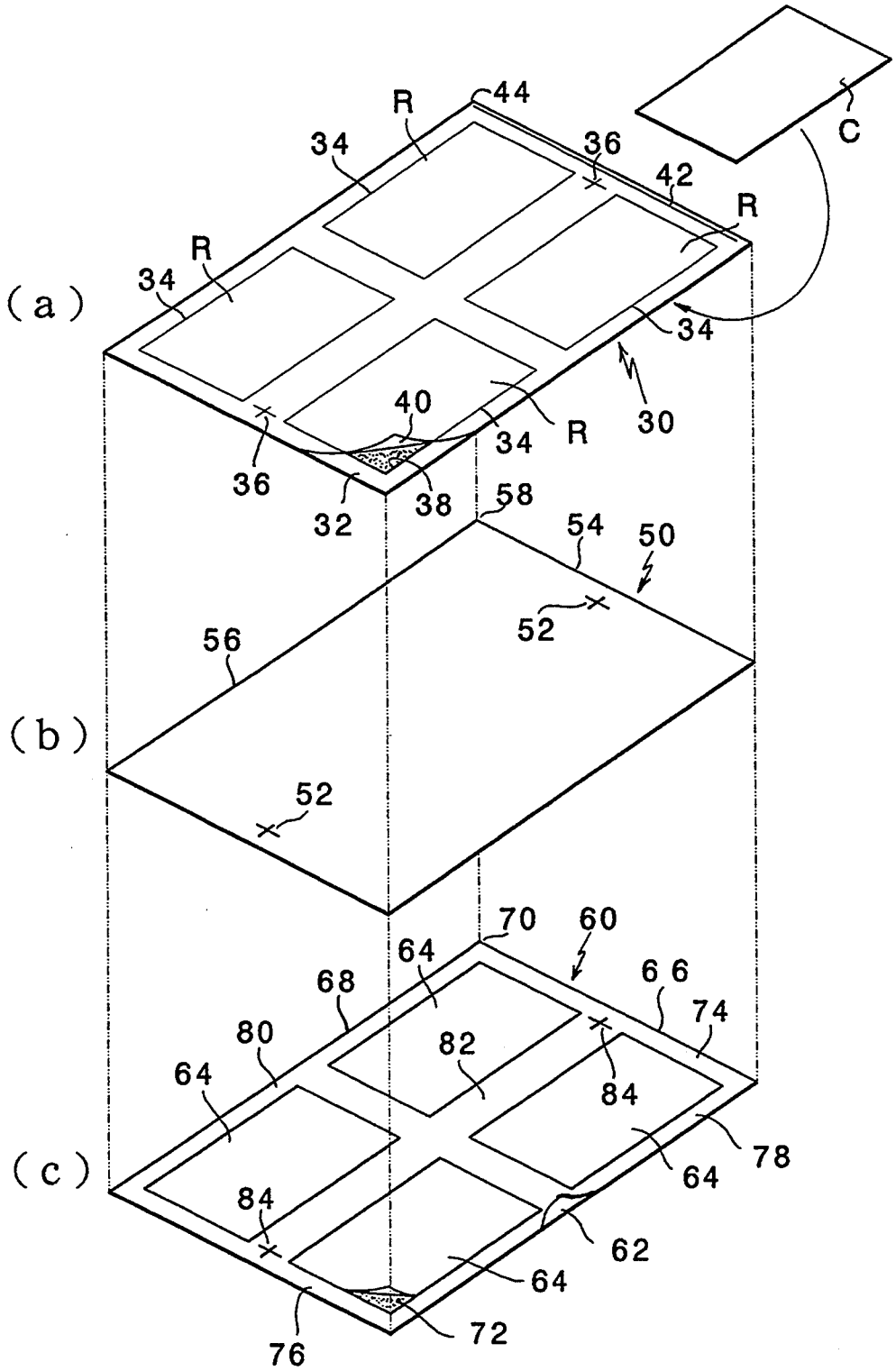
FIG. 2 is an exploded perspective view showing (a) an embodiment of the original positioning holder for card printing according to the present invention, (b) an embodiment of the test print sheet which may be used for the implementation of the card printing method of the present invention, and (c) an embodiment of the card printing paper which may be used for the implementation of the card printing method of the present invention, along with their mutual relationship.

FIG. 2(*a*) shows an embodiment of the original positioning holder for card printing according to the present invention. The original positioning holder for card printing generally denoted with numeral 30 carries thereon, by printing or the like, original set up position designating marks 34 for designating the positions of original set up regions R for card-like originals C such as business cards on a base sheet 32 consisting of paper, plastic or other material of a size suitable for being fed into the printing unit of the stencil printing device 1 as described above, and registration marks 36 provided at positions outside the original set up regions R designated by the original set up position designating marks 34 and at a prescribed relationship to the original set up position designating marks 34.

The original set up position designating marks 34 are printed in ink of non-sensible color which cannot be read by the image scanner 3 of the original image reading unit 5, and are placed in mutually spaced relationship in a plurality of locations, in four locations in the present embodiment, on the single original positioning holder for card printing 30 for designating the original set up regions R. In this embodiment, the original set up regions R are arranged in two by two arrangement which is symmetric both vertically and laterally.

Each of the original set up regions R is provided with a layer of an adhesive agent 38 for removably attaching a card-like original C thereto in which the layer may either cover the entire region, or formed as spots or bands.

The registration marks 36 are called as "tombo (in Japanese)", and are printed in black ink or the like which can be read by the image scanner S of the original image reading unit 5.

One side 42 of a transparent sheet 40 is attached to the base sheet 32 so that the transparent cover sheet 40 may cover and protect the original set up regions R designated by the original set up position designating marks 34 but can be manually opened up with the side 42 attached to the base sheet 32 serving as a hinge.

FIG. 2(*b*) shows an example of test print sheet which may be used for carrying out the card printing method according to the present invention. The test print sheet generally denoted with numeral 50 has a prescribed standard size for paper, plastic and other sheets that can be automatically fed into the printing unit, or more preferably the same size as the base sheet 32 of the original positioning holder for card printing 30, and carries registration marks 52 printed thereon. The positions of the registration marks 52 in a coordinate system having a point of origin at an intersection 58 between a reference leading edge 54 and a reference side edge 56 for automatic paper feed on the test print sheet 50 correspond to the positions of the registration marks 36 on the original positioning holder for card printing 30 in a similar coordinate system having a similar point of origin 44 defined on the original positioning holder for card printing FIG. 2(*c*) shows an example of card printing paper which may be used for carrying out the card printing method according to the present invention. The card printing paper generally denoted with numeral 60 carries a prescribed number of card-like printing sheets 64 in a removable manner on a base sheet 62 having a prescribed standard size suitable for automatic feeding to the printing unit of the stencil printing device 1, or more preferably the same size as the base sheet 32 of the original positioning holder for card printing 30.

The number of the card-like printing sheets 64 mounted on each base sheet 62 is identical to the number of the original set up regions R designated by the original set up position designating marks 34 on the original positioning holder for card printing and the positions of the card-like printing sheets 64 mounted on each base sheet 62 coincide with the corresponding original set up regions R designated by the original set up position designating marks 34 on the original positioning holder for card printing When a printing master plate is to be prepared by repeated duplication of an original, the number of the card-like printing sheets 64 will be a multiple of the number of the original set up regions R designated by the original set up position designating marks 34 on the original positioning holder for card printing 30.

The positions of the card-like printing sheets 64 on the base sheet 62 in a coordinate system having a point of origin at an intersection 70 between a reference leading edge 66 and a reference side edge 64 for automatic paper feed on the card-like printing sheets retaining sheet 60 correspond to the positions of the corresponding original set up position designating marks 34 on the original positioning holder for card printing 30 in a similar coordinate system having a similar point of origin 44 defined on the original positioning holder for card printing If the card-like printing sheets 64 consist of labels, they may be attached to the base sheet 62 by means of an adhesive layer formed on the reverse side of each of the card-like printing sheets 64. On the other hand, if the card-like printing sheets 64 consist of business card paper or the like having no adhesive layer on its reverse side, the card-like printing sheets 64 may be attached to the base sheet 62 by means of an adhesive layer 72 provided on the base sheet 62 as illustrated in the drawing.

Figure 3:
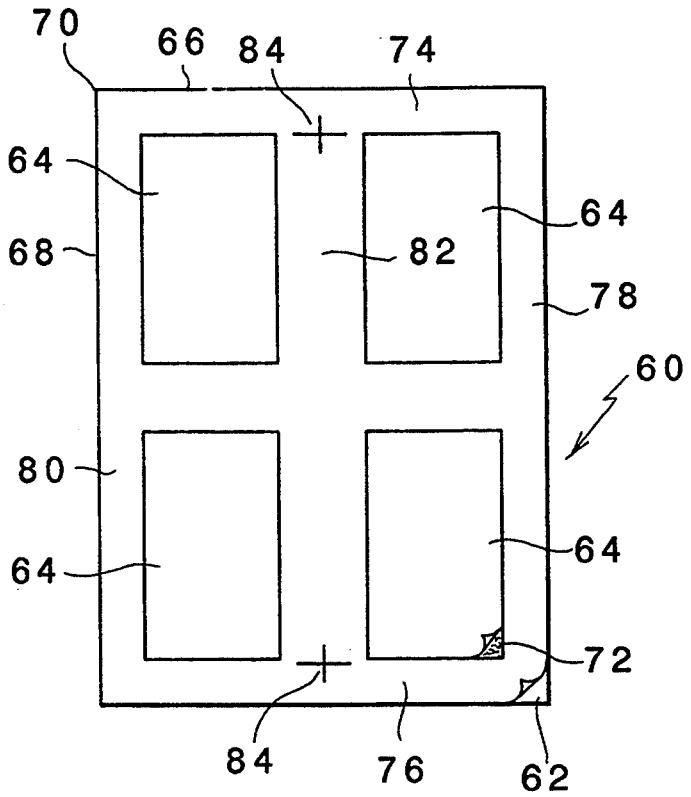
FIG. 3 is a more detailed plan view showing the card printing paper.
Figure 4:
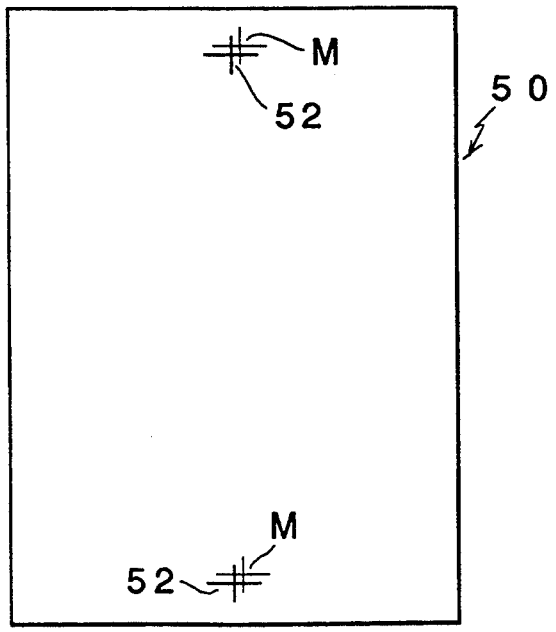
FIG. 4 is a plan view of a test print made on the test print sheet for the implementation of the card printing method of the present invention.

FIG. 3 shows in greater detail the card printing paper 60 in which the card-like printing sheets 64 are attached to the base sheet 62 by means of the adhesive layer 72 provided on the surface of the base sheet In this card printing paper 60 also, the positions of the card-like printing sheets 04 on the card printing paper 60 coincide with the original set up regions R designated by the original set up position designating marks 34 on the original positioning holder for card printing 30, and, in the same way as the layout of the original set up regions R on the original positioning holder for card printing 30, are in a two by two arrangement which is symmetric both vertically and laterally. Further, the head margin 74 is equal to the bottom margin 76, and the side margins 78 and 80 are equal to each other. Thus, the card printing paper 60 does not have any specific directivity as far as paper feeding operation is concerned, and may be fed from either direction, from its head margin 74 first or its bottom margin 76 first.

The central margin 82 in the card printing paper 60 is equal to or greater than the widths of the paper separation roller 16 and the paper feed timing roller 17, and align with the paper separation roller 16 and the paper feed timing roller 17 during the paper feeding process.

The base sheet 02 of the card printing paper may carry registration marks 84 printed thereon in prescribed locations for checking purpose.

The reverse surface of the base sheet 62 may be optionally provided with registration marks 52 so that the reverse surface of the card printing paper 00 may also serve as a test print sheet 50.

When printing cards, card-like originals C are placed on the base sheet 32 according to the original set up position designating marks 34 on the base sheet 32 by opening the transparent cover sheet 40 of the original positioning holder for card printing Thus, the card-like originals C are mounted and retained on the original set up regions R designated by the original position set up position designating marks 34 on the base sheet 32 by virtue of the adhesive layer 38.

Thereafter, the transparent cover sheet 40 is restored to its original state, and the original positioning holder for card printing 30 is fed into the original reading unit 5 of the stencil printing device 1. As a result, the image scanner 3 reads the images of the card-like originals C held by the original positioning holder for card printing 30 and the registration marks 36 of the original positioning holder for card printing 30, and the thermal head 7 forms corresponding stencil master plates in the stencil master plate sheet S by duplication according to the image data read by the image scanner By this process of making stencil master plates by duplication, the stencil master plate image parts for the images of the card-like originals C are made in locations corresponding to the positions of the card-like originals C on the original positioning holder for card printing 30 along with stencil master plate registration mark parts which are simultaneously made in locations corresponding to those of the registration marks 36 on the original positioning holder for card printing 30.

Then, the test print sheet 50 is placed on the paper feed table 15 of the automatic paper feed unit 19 with its reference leading edge 54 and reference side edges 56 for automatic paper feeding aligned with the corresponding reference lines on the paper feed table 15, and is automatically fed into the stencil printing unit comprising the printing drum 11 and the press roller 13 so that a test print may be made on the test print sheet 50 by using the stencil master plates formed on the master plate sheet S as described above.

As a result of this test print, the registration marks M are printed on the test print sheet 50 by the stencil master plate registration mark parts for the registration marks. If the printed registration marks M and the registration marks 52 which were printed thereon in advance coincide with each other, a proper registration will be obtained. On the other hand, the registration marks M and the registration marks 52 not coincide with each other, a proper registration will not be obtained. In this case, by observing the relative deviation between the registration marks M and the registration marks 52, the automatic paper feed position in the stencil printing device 1 is adjusted so as to eliminate this deviation.

The adjustment of the automatic paper feed position is carried out vertically by adjusting the longitudinal positioning of the printing paper and laterally by adjusting the widthwise placement of the printing paper on the paper feed table 15.

Once the automatic paper feed position adjustment is completed so as to match the registration marks M and the registration marks 52 with each other, the card printing paper 60 is placed on the paper feed table 15 of the automatic paper feed unit 19 with its reference leading edge 66 and reference side edges 68 for automatic paper feeding aligned with the corresponding reference lines on the paper feed table 15, and is automatically fed into the stencil printing unit comprising the printing drum 11 and the press roller so that a final print may be made by using the stencil master plates formed on the master plate sheet S as described above.

By this final printing process, images are printed in prescribed locations of the card-like printing sheets 64 by using the stencil master plate image parts for the card-like originals.

The printed card printing paper 60 is stacked up on the paper ejection table 22 of the paper ejection unit 21. In this case, the printing ink forming the printed images on the card-like printing sheets 64 may still be wet, but, even if this wet printing ink should adhere to the reverse side of the overlaid card printing paper or, in other words, offsetting should occur, the ink would adhere only to the reverse side of the base sheet 62 and would not smear the card-like printing sheets 64.

The final print will include the registration marks printed by the stencil master plate registration mark parts for the registration marks, but they are printed in the margins of the card-like printing sheets 64, and will not affect the quality of the card printing in any way.

When the card printing paper 00 does not have any directivity with regard to its feeding direction, either the top margin first or the bottom margin first, it is also possible to feed the paper with its bottom margin or its trailing edge first.

In this case, when there is only one card-like original C with which a stencil master plate is to be made at a prescribed location of a stencil master plate sheet S by using the original positioning holder for card printing 30, and only one of the card-like printing sheets 64 on the single card printing paper is printed, then another card-like printing sheet 04 on the card printing paper 60 can be printed by feeding the card printing paper 60 which has been printed once with its feeding direction reversed, thereby minimizing the waste of the printing paper. If the original positioning holder for card printing 30 includes only two original set up regions R as is the case with the embodiment illustrated in FIGS. 6 and 7, and the printing process is repeated twice by changing the feeding direction of the card printing paper, there will be no waste of the card-like printing sheets 64.

If there are two card-like originals C when using the original positioning holder for card printing 30 including four original set up regions R as illustrated in FIG. 2, then the originals C may be placed on one side, either laterally or longitudinally, of the original positioning holder for card printing 30 when preparing stencil master plates therefrom, and all the card-like printing sheets 64 on the card printing paper 60 may be printed by feeding the card printing paper 60 twice as described above.

If the central margin 82 in the card printing paper 60 is equal to or greater than the widths of the paper separation roller 16 and the paper feed timing roller 17, and align with the paper separation roller 16 and the paper feed timing roller 17 during the paper feeding process, the paper separation roller 16 and the paper feed timing roller 17 engage with only the central margin 18 without touching the card-like printing sheets 64 during the process of feeding the card printing paper 60, and the card-like printing sheets 64 would not be rubbed by the paper separation roller 16 and the paper feed timing roller 17.

Thus, the card-like printing sheets 64 would not be smeared, and, even when the card printing paper 60 is required to be fed again, for instance, for color printing or full utilization of the card-like printing sheets 64 on each sheet of card printing paper 00, the printed images would not be disturbed by the paper separation roller 16 and the paper feed timing roller 17 which would otherwise rub on the card-like printing sheets 64.

Further, even when the paper separation roller 16 is made of rubber material having a high coefficient of friction for reliable paper separation, according to this arrangement, there will be no possibility of inadvertently peeling the card-like printing sheets 64 from the base sheet 62 during the process of separating paper sheets by the paper separation roller 16. Thereby, the card-like printing sheets 64 are not required to be securely adhered to the base 62. It means that the card-like printing sheets 64 can be readily peeled off from the base sheet 62 when necessary prints are made and the card-like printing sheets 64 are required to be separated from the base sheet 62, and the possibility of damaging or curling the card-like printing sheets 64 during the process of peeling them from the base sheet 62 can be also reduced.

Figure 5:
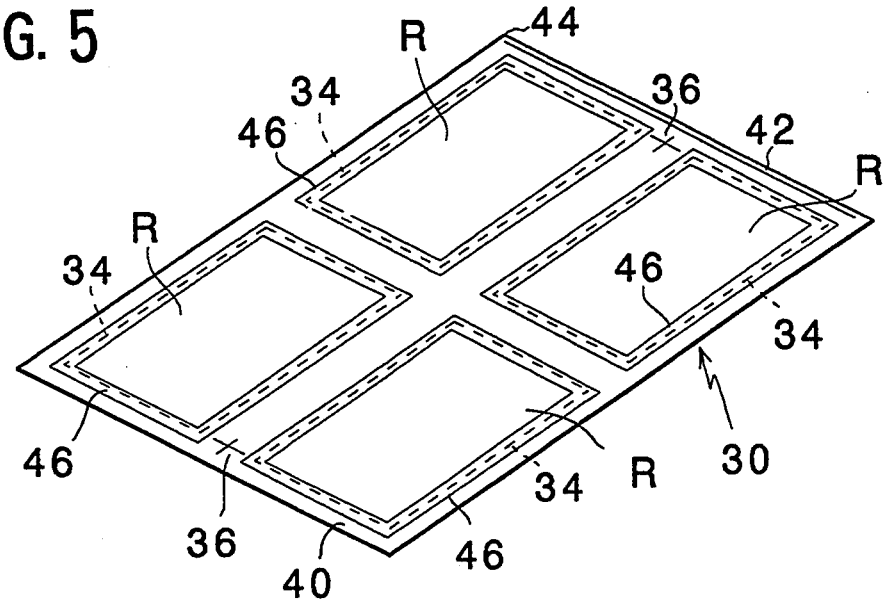
FIG. 5 is a perspective view of a second embodiment of the original positioning holder for card printing according to the present invention.

FIG. 5 shows another embodiment of the original positioning holder for card printing according to the present invention- In FIG. 5, the parts corresponding to those in FIG. 2(*a*) are denote with like numerals. In this embodiment, for the purpose of preventing the creation of shadows along the surrounding edge of each of the card-like originals C placed on the base sheet 32 due to the thickness of the card-like originals C, the transparent cover sheet 40 is provided with mask parts 46 each consisting of opaque paint or the like applied along the part corresponding to the surrounding edge of the corresponding card-like original C.

According to this original positioning holder for card printing 30, even when the card-like originals C consist of business cards or the like having a considerable thickness, no shadow is created in the stencil master plates at areas corresponding to the surrounding periphery of each of the card-like originals C, and a high quality card printing can be accomplished without involving undesirable smears.

Figure 6:
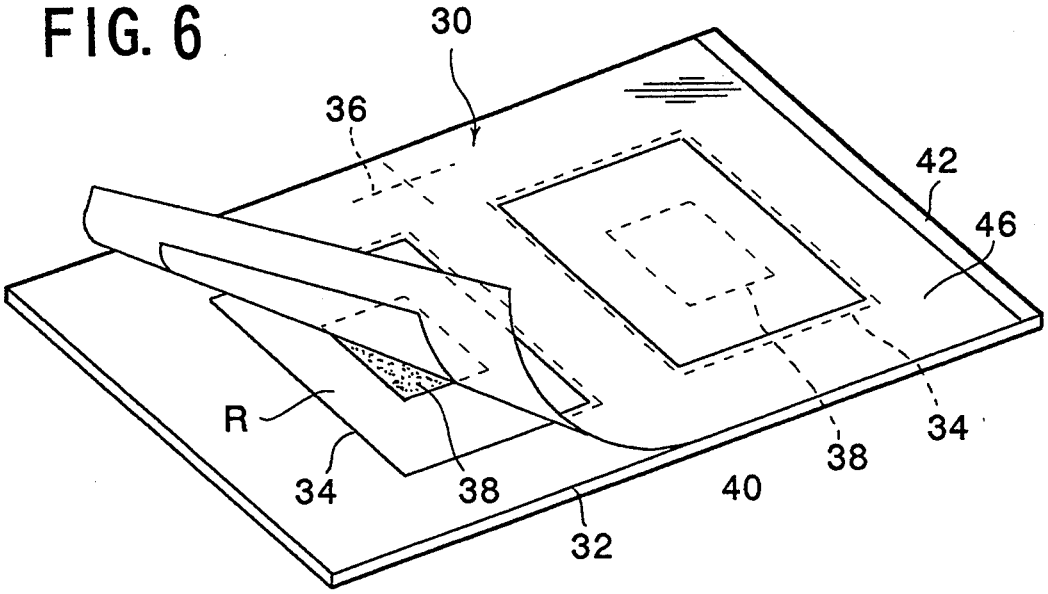
FIG. 6 is a perspective view of a third embodiment of the original positioning holder for card printing according to the present invention.
Figure 7:
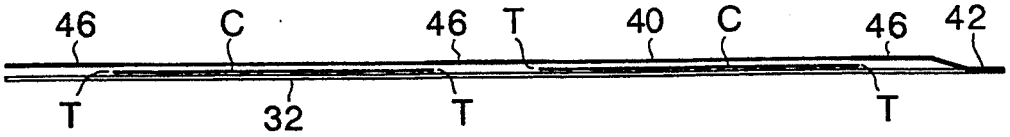
FIG. 7 is a side view of the original positioning holder illustrated in FIG. 6.

FIGS. 6 and 7 show a third embodiment of the original carrier sheet according to the present invention which is similar to the embodiment illustrated in FIG. 5, and the parts corresponding to those of the previous embodiment are denoted with like numerals.

In this embodiment, there are only two original set up regions R for originals C such as business cards, and there is only one registration mark 36 located outside of the original set up regions R at a prescribed positional relationship to the original set up position designating marks 38. In this case, the adhesive layer 38 is limited to a small rectangular area in the central part of each of the original set up regions R.

The part of the transparent cover sheet 40 corresponding to the peripheral parts of the original set up regions R and all the marginal area, or a substantially entire area of the transparent cover sheet 40 except for window-like areas which show through the originals C (these window-like areas excluding the marginal edges of the originals) is formed as a mask part 46 of non-sensible color which consists of an opaque region which are white or otherwise has a low optical absorption, and cannot be read by the image scanner or the like. In this case, the registration mark will be provided on the surface of the cover sheet 40. The mask part 46 can be formed by application of white or other opaque paint or tinting of the plastic film which forms the transparent cover sheet 40.

Thus, according to this original carrier sheet also, the step T which may be created between the outer peripheral parts of the originals C set up in the original set up regions R and the original set up surface of the base sheet 32 is covered by the mask part 46 of non-sensible color of the transparent sheet as illustrated in FIG. 7.

Since the mask part 46 of non-sensible color is opaque, the illuminating light is prevented from being illuminated on it during the process of duplication or image reading, and the generation of shadow images of the outer peripheral parts of the originals C can be avoided.

According to a broad concept of the original carrier holder of the present invention, each base sheet 32 may carry only one original set up region. Thus, according to this broad concept, when an original is placed on the original set up region on the original set up surface of the base sheet according to the original set up position designating mark, and the transparent cover sheet is placed thereon, the step which may be created between the periphery of the original placed on the original set up region is conveniently covered by the opaque mask part of nonsensible color, and this part is prevented from being illuminated during the process of duplication or image reading because the mask part is opaque. When this original carrier is used for normal duplication without involving any step of master plate making, the registration mark is not required to be placed on the transparent cover sheet or the base sheet.

Thus, even when the original consists of a business card, a post card or other material having a substantial thickness, and a substantial step is created between the outer periphery of the original and the original set up surface of the base sheet, generation of shadow images can be avoided.

Although the present invention has been described with regard to specific embodiments thereof, a person skilled in the art can readily conceive various other embodiments without departing from the spirit of the present invention.

As can be understood from the above description, according to the card printing method and the original positioning holder for card printing of the present invention, a card-like original is positioned on the original positioning holder for card printing according to the original set up position designating mark, and a stencil master plate is made by using the entire original positioning holder for card printing by duplication. Therefore, the stencil master plate part for the image of the card-like originals formed in the position corresponding to the position of the card-like original laid out on the original positioning holder for card printing along with the registration mark. Thus, by printing on the test print sheet at least the registration mark by using the stencil master plate registration mark part for the registration mark by using the thus prepared stencil master plate sheet, the direction and magnitude of misregistration can be evaluated from the relative positions of the two registration marks on the test print sheet, and a proper registration can be readily and accurately achieved by adjusting the automatic paper feed position so as to eliminate such a misregistration.

Through the use of the original positioning holder for card printing, the positioning of the card-like originals can be easily and accurately carried out without regard to the number of the card-like originals that are to be handled at a time when preparing a printing master plate, and even inexperienced personnel can readily print business cards or the like by using a stencil printing device equipped with an automatic cut sheet paper feeder for normal office use.

Further, according to the card printing paper of the present invention, since the card-like printing sheet is not provided with any adhesive layer, and is attached to the base sheet by virtue of the adhesive layer provided on the base sheet, once the card-like printing sheet is removed from the base sheet, it is no more than a plain card without any adhesive layer which is suitable for printing a business card or the like.

What we claim is:

1. A card printing method, comprising the steps of:

positioning and setting up a card-like original on an original positioning holder carrying an original set up position designating mark for designating a region for setting up said card-like original and a reference registration mark which is located outside said original set up region designated by said original set up position designating mark at a prescribed positional relationship thereto, according to said original set up position designating mark;

making a printing master plate from said card-like original along with said original positioning holder by duplication, said printing master plate including a master plate image part corresponding to said card-like original and a master plate mark part corresponding to said registration mark;

printing at least said registration mark on a test print sheet carrying a reference registration mark printed thereon and fed to a printing unit, by using said printing master plate;

detecting a misregistration from relative positions of said registration mark printed on said test print sheet with said printing master plate and said reference registration mark;

feeding a base sheet carrying a card-like printing sheet in a removable manner on a position corresponding to said original set up region designated by said original set up position designating mark to said printing unit with said misregistration resolved by adjusting an automatic paper feeding position; and printing an image of said card-like original with said master plate image part on a prescribed location of said card-like printing sheet by using said master plate image part of said printing master plate.

2. A card printing method according to claim 1, wherein each original positioning holder is provided with a plurality of original set up regions, and said base sheet carries a same number of card-like printing sheets in corresponding locations on said base sheet.

3. A card printing method according to claim wherein said original set up regions are arranged on said original positioning holder symmetrically both longitudinally and laterally.

4. A card printing method according to claim 3, wherein only a part of said original set up regions are mounted with said card-like originals, and said printing step is repeated twice by changing a feeding direction of said base sheet so that a maximum number of said card-like printing sheets may be printed.

* * * * *

UNITED STATES PATENT AND TRADEMARK OFFICE

CERTIFICATE OF CORRECTION

PATENT NO. : 5,337,669
DATED : August 16.1994
INVENTOR(S) : Kanai

It is certified that error appears in the above-indentified patent and that said Letters Patent is hereby corrected as shown below:

COLUMN 12

Line 42, "claim" should read --claim 2--.

Signed and Sealed this

Eleventh Day of April, 1995

*Attest:*

Bruce Lehman

BRUCE LEHMAN

*Attesting Officer*

*Commissioner of Patents and Trademarks*